United States Patent [19]

Moe

[11] Patent Number: 4,761,969

[45] Date of Patent: Aug. 9, 1988

[54] REFRIGERATION SYSTEM

[76] Inventor: James S. Moe, 376 Boisfort, Curtis, Wash. 98558

[21] Appl. No.: 12,163

[22] Filed: Feb. 9, 1987

[51] Int. Cl.[4] ..... F25D 3/12

[52] U.S. Cl. ..... 62/388; 62/407

[58] Field of Search ..... 62/384, 388, 407, 440

[56] References Cited

U.S. PATENT DOCUMENTS

| | | | |
|---|---|---|---|
| 2,170,332 | 8/1939 | Justheim | 62/388 |
| 2,836,963 | 6/1958 | Fox | 62/55 |
| 3,225,558 | 12/1965 | Wulfken | 62/384 |
| 3,864,936 | 2/1975 | Frank et al. | 62/384 |
| 3,906,744 | 9/1975 | Knapp et al. | 62/384 |
| 4,457,142 | 7/1984 | Bucher | 62/388 |
| 4,502,293 | 3/1985 | Franklin, Jr. | 62/388 |
| 4,593,536 | 6/1986 | Fink et al. | 62/388 |

*Primary Examiner*—Ronald C. Capossela

*Attorney, Agent, or Firm*—Nies, Webner, Kurz & Bergert

[57] ABSTRACT

A non-mechanical refrigeration system particularly for use in a large insulated container such as a truck or railroad car for maintaining perishables at a desired low temperature during shipment. A cryogenic material such as liquid $CO_2$ is used in a plurality of modes to permit or prevent exposure of the foodstuffs to $CO_2$ vapors.

5 Claims, 2 Drawing Sheets

REFRIGERATION SYSTEM

The present invention relates to refrigeration systems for transporting perishable products, and more particularly to a method and apparatus for utilizing cryogenic materials, especially carbon dioxide, to maintain a predetermined low temperature in a chamber in trucks, railroad cars or the like for transporting or storing perishable products without mechanical refrigeration units.

One of the primary concerns in transporting or storing perishable products is the prevention of spoilage or contamination of the products. This has been achieved by maintaining such products at a temperature and, optionally in an atmosphere, which retards bacterial growth, and consequently, preserves freshness and/or extends shelf-life of the products.

Historically, the first refrigeration systems for railroad cars and trucks utilized mechanical refrigeration units. However, these systems have proven undesirable, both in cost of manufacture and in time required to test and maintain the system equipment in good repair and to repair or replace the equipment subsequent to breakdown.

More recently, non-mechanical refrigeration systems have been proposed, as exemplified by U.S. Pat. Nos. 3,560,266 to Rubin and 4,593,536 to Fink et al., both of which teach the use of solid dry ice, known as $CO_2$ snow formed by the conversion of liquid carbon dioxide.

The patent to Rubin discloses a non-mechanical refrigeration system in which liquid $CO_2$ is injected into a cold plate container mounted within a refrigeration chamber. Upon injection, the liquid $CO_2$ is converted to $CO_2$ snow, and as the $CO_2$ snow sublimates, $CO_2$ vapors are formed which are directed into the compartment to provide the desired refrigeration.

Similarly, the patent to Fink et al. discloses a non-mechanical refrigeration system for a vehicle in which liquid $CO_2$, when pumped into a compartment located above the cooling chamber, is converted to $CO_2$ snow. The system of Fink et al. has two modes of operation; a first mode in which both $CO_2$ snow and $CO_2$ vapors formed in the compartment are directed into the chamber for contact with, and cooling of, the contained products, and a second mode in which cooling of perishable products in the chamber is accomplished by directing only the $CO_2$ vapors into the chamber.

Non-mechanical refrigeration systems of the type disclosed by Rubin and Fink et al. however, have also proven to be undesirable where the perishable products are of the kind which during shipment, must be chilled but cannot be allowed to be contacted by $CO_2$ vapors. For example, perishable products such as lettuce, cabbage, asparagus, etc., in part or entirely, will turn black or otherwise acquire a noxious discoloration, which renders the products aesthetically unappealing to a consumer, upon exposure to $CO_2$ vapors.

It is therefore a primary object of the present invention to provide a non-mechanical refrigeration system to maintain a predetermined low temperature in a refrigeration chamber used for storing or shipping perishable products which will overcome the deficiencies and disadvantages of the prior art systems.

Another object of the present invention is to provide a refrigeration chamber in which the refrigerant is a cryogenic material.

Still another object is to provide a non-mechanical cryogenic refrigeration system which utilizes solid and gaseous forms of a cryogen to maintain perishable products at predetermined low temperatures for predetermined periods of time so that spoilage or contamination of the products is prevented.

It is a further object of the present invention to provide improved non-mechanical cryogenic refrigeration systems which utilize $CO_2$ snow as the refrigerant agent and which may be operated in different modes selectively to permit or to prevent exposure of the perishable products to $CO_2$ vapors.

BRIEF DESCRIPTION OF THE DRAWINGS

These and other objects, features and advantages will become apparent upon a reading of the following detailed description of the present invention when taken in conjunction with the accompanying drawings, in which.

DETAILED DESCRIPTION OF THE INVENTION

Figure 1:
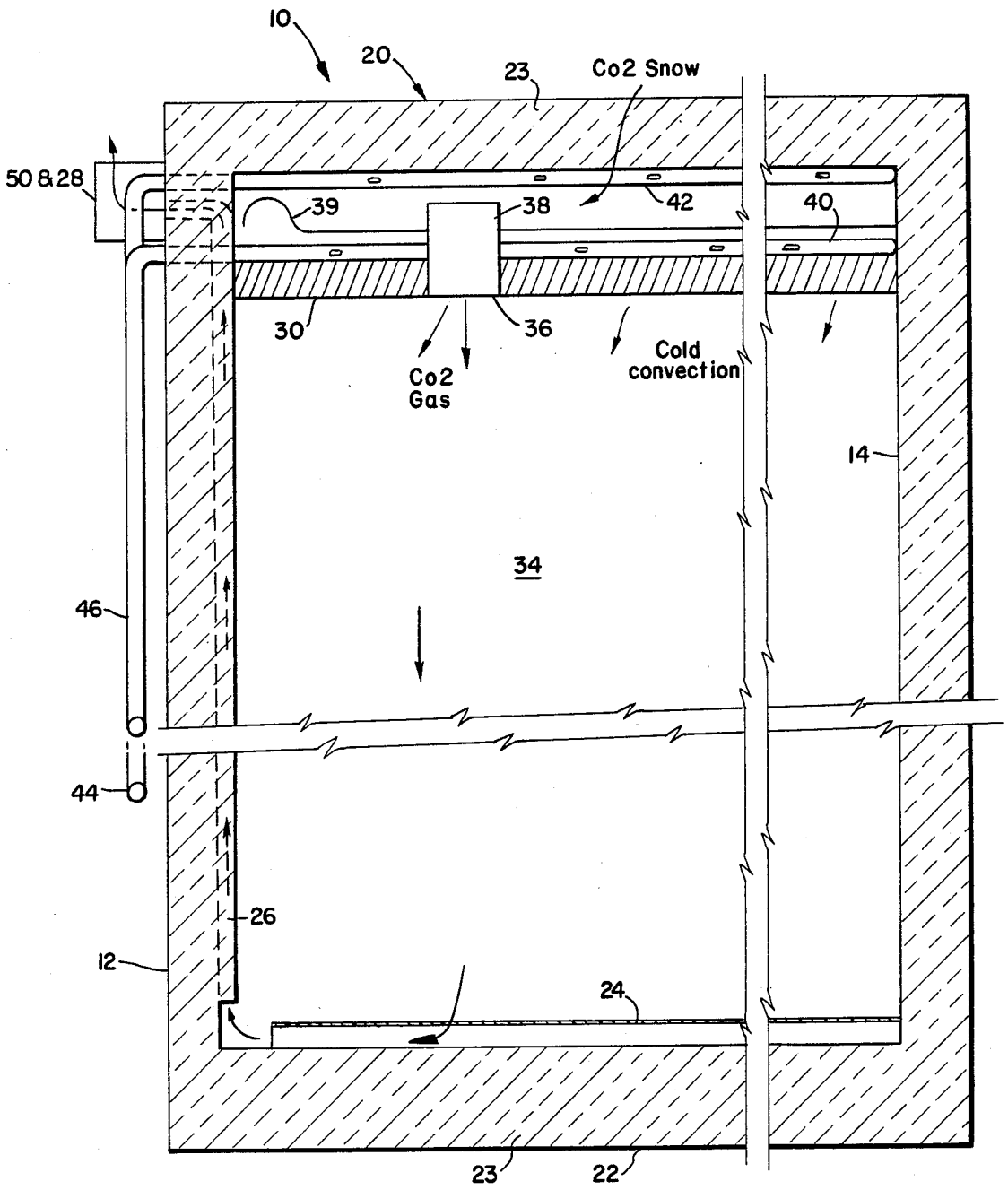
FIG. 1 is a vertical longitudinal section, of a container for perishable products embodying the non-mechanical refrigeration system of the present invention.
Figure 2:
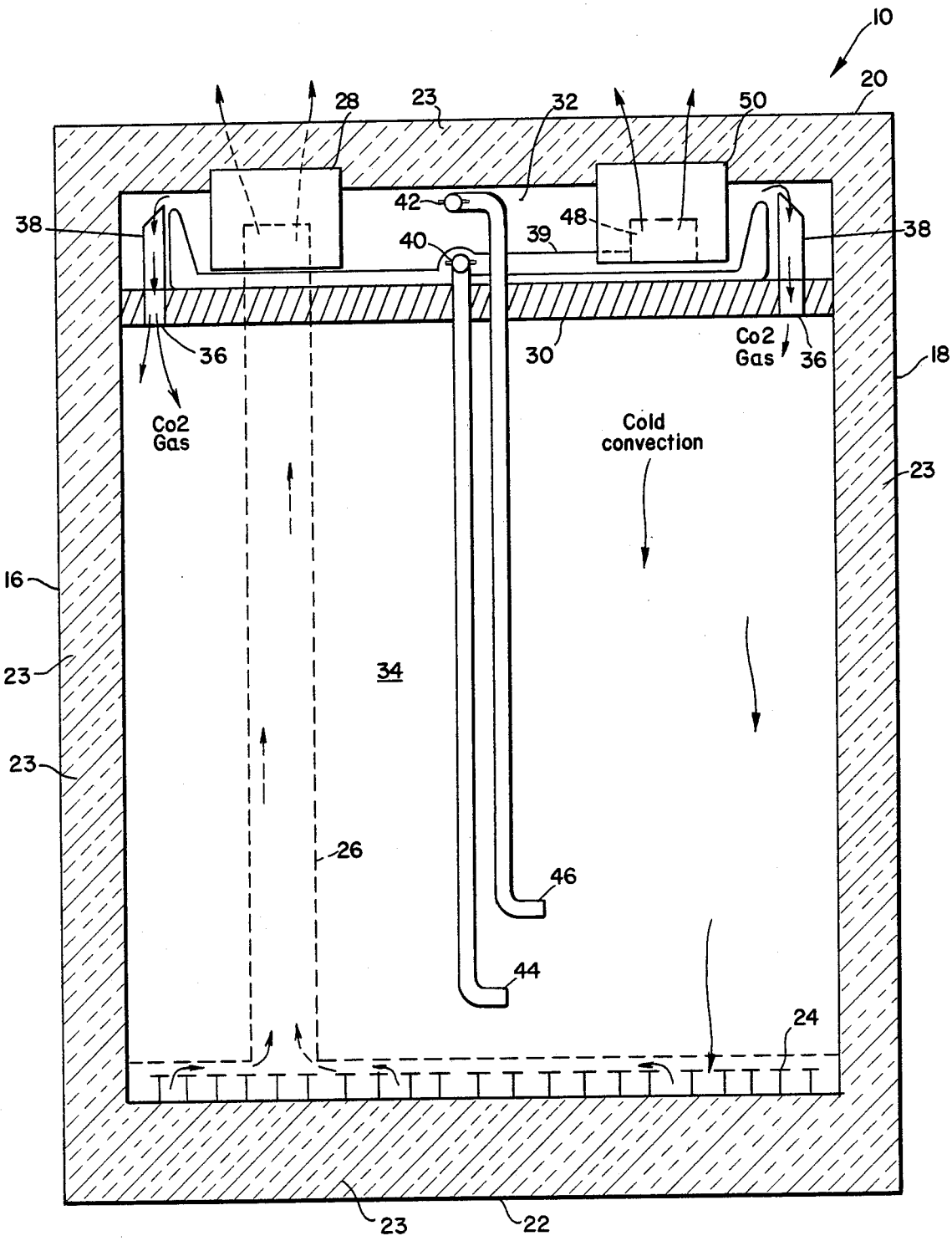
FIG. 2 is a vertical transverse section, of the container illustrated in FIG. 1.

Referring now to FIGS. 1 and 2, wherein like numerals represent like or similar parts, there is generally illustrated a container 10 of the present invention in which perishable products may be placed for shipping or storage. The container may be embodied as a railroad car or trailer van, or it may be embodied as a compartment secured to and transported on a railroad car or flat-bed trailer. The container is preferably of rectangular shape including first and second, opposing, end walls 12, 14, respectively, opposing side walls 16, 18, a top member 20 which forms the roof of the container and a bottom member 22 which forms the floor.

The walls, roof and floor are thermally insulated as at 23 in accordance with conventional practice. Above the upper surface of the floor in container 10 channels 24 are formed which extend between the opposing end walls (the purpose of which will be described below), and may constitute a single element in which a plurality of channels is formed or alternatively may constitute a plurality of individual channel members secured to the upper surface of floor 22 and disposed side-by-side. Preferably drainage members, such as floor channels, tubes and drains, are incorporated into the container floor in a conventional manner. The drainage members are to be functional only during cleaning; not during shipping or storage.

Distribution channels for gaseous $CO_2$ are preferably formed on the insulated panel surfaces which define the container interior. The end wall 12 is further provided with a channeled venting region 26 which extends vertically from the panel bottom to the panel top. The venting region 26 communicates with the ambient via appropriate ducting assembled in a conventional manner connected with a flow vent restrictor 28 mounted on the end wall 12 so that gases flowing from the floor of the container upwardly through the venting region 26 can escape through vent restrictor 28 to the ambient.

At an upper region of the container 10, partition or bunker 30 extends substantially horizontally between the opposing interior faces of the end and side walls.

The bunker 30, which may be formed as a single continuous panel member or as a plurality of insulated panel sections supported side-by-side, divides the container into an upper, insulated, storage compartment 32 for the cryogenic material and a lower, insulated, storage compartment 34 for the perishable product.

The bunker 30 includes through-openings or distribution ports 36, preferably located at regions in proximity to the side walls 16 and 18 of the container. The distribution ports facilitate communication between the upper compartment and the lower compartment so that when cryogenic material is stored in the upper compartment, vapors formed upon sublimation of the cryogenic material will pass from the upper compartment into the lower compartment and downwardly around the perishables thence into the vent passage 26 via channels 24. Tubular housings 38 may be fitted within the distribution ports. The housings include an upper portion which extends a predetermined distance above the upper surface of the bunker 30. A mesh or screen may be secured over the top of the distribution ports or the tubular housings to prevent passage of solid cryogenic material into the ports.

Supported within the upper compartment, and preferably extending between the two end walls, are a bladder 39, a chill manifold 40 and a freeze manifold 42.

Each manifold (the function of which will be described below) is formed of one or more pipe sections and includes nozzle-like openings, or fittings, disposed at spaced intervals along the length thereof. Each manifold further has one pipe section extending through a sealable opening in, and downwardly along the outer surface of one end wall of the container. The pipe sections of each manifold 40 and 42 which extend along the exterior surface of the end wall of the container are preferably disposed in close proximity to one another and each pipe section terminates in an end (44, 46) which is adapted for connection to a cryogenic material source, preferably liquid $CO_2$. The chill manifold 40 is supported on the upper surface of bunker 30 with the openings or nozzles directed into the upper compartment. The freeze manifold 42 is supported in the upper region of the upper compartment with its openings or nozzles also directed into the upper compartment. Both manifolds are preferably disposed centrally of the upper compartment to assure even distribution of the cryogenic material.

The bladder 39 preferably constitutes a flexible bag-like member having an outlet opening coupled in a suitable manner with a bladder venting conduit 48 (FIG. 2), which, in turn, is connected to bladder vent restrictor 50 mounted in end wall 12. The bladder vent restrictor 50 permits $CO_2$ vapors, formed in the bladder upon sublimation of the $CO_2$ snow, to escape to the ambient when the resulting vapor pressure in the bladder exceeds a predetermined value while preventing the passage of the vapors into the interior of the container 10. The bladder overlies the upper surface of bunker 30 and houses the entire chill manifold 40 with the exception of the one pipe section which passes through the container end wall.

It is to be understood that both the floor vent restrictor 28 and the bladder vent restrictor 50, mounted in the first end wall of the container and communicating with the ambient, are trap-type restrictors which use the weight of the $CO_2$ vapors to restrict the flow of the vapors out of the container.

The following description of the operation of the present invention contemplates $CO_2$ as the preferred cryogen although other cryogens might be used. Thus the cryogenic source material will be liquid $CO_2$, the cryogenic material formed in the upper compartment will be $CO_2$ snow, and the vapors formed upon sublimation of the $CO_2$ snow will be $CO_2$ vapors.

The present invention is capable of operation in any one of three modes:

(a) a first, "freeze mode" in which all $CO_2$ vapors generated in the vapor compartment are caused to flow into the lower compartment through the distribution ports for freezing or maintaining in a frozen state, perishable products (such as selected foods, blood, chemicals, etc.) placed in the lower compartment of the chamber;

(b) a second, "chill mode" in which perishable products subject to discoloration (e.g. foods such as lettuce, cabbage, etc.) may be refrigerated or chilled without subjecting the products to any $CO_2$ vapors; and (c) a third, "combined mode", in which a predetermined limited amount of $CO_2$ vapors may be allowed to flow into the lower compartment, for refrigerating or chilling perishable products (such as berry produce, fish, meats, etc.) where exposure of the perishable products to $CO_2$ vapors retards or substantially prevents bacterial growth and extends shelf life.

In the "freeze mode" of operation, liquid $CO_2$ is introduced into end 46 of the exterior pipe section of freeze manifold 42, and caused to flow out of the spaced openings or fittings carried by freeze manifold 42. As the liquid $CO_2$ exits from the openings or fittings, it is converted to $CO_2$ snow. This process is continued until the snow fills the upper compartment 32 (i.e. the volume above bunker 30) with a predetermined amount sufficient for a duration of time during which a perishable product, placed in the lower compartment, will be shipped or otherwise stored. As the $CO_2$ snow sublimes, $CO_2$ vapors are formed. The vapors, which are heavier than air, flow downwardly with a convection effect into the lower compartment through the distribution ports 36, or (when used) through the tubular housings 38 fitted in the distribution ports. The $CO_2$ vapors flow around and through the product to the channels 24 at the container bottom member 22, then along channels 24 to the end wall vertical vent 26, and finally upwardly along the vertical vent to the vent restrictor 28, and out through the vent restrictor to the ambient. During this mode of operation, the bladder 39 assumes a collapsed state, lying substantially flush with, and atop, the upper surface of the bunker 30 without interferring with vapor flow through the distribution ports 36 or the upstanding tubular fittings 38.

In the "chill mode" of operation, liquid $CO_2$ is introduced into end 44 of the exterior pipe section of chill manifold 40, and caused to flow out of the spaced openings or fittings carried by the chill manifold 40, and into the interior of the bag-like bladder 39. As the liquid $CO_2$ exits from the openings or fittings, it is converted to snow. Formation of the snow continues until a predetermined quantity (sufficient for a duration of time during which a perishable product, placed in the lower compartment, will be shipped or otherwise stored) has filled the bladder. Due to the expandable nature of the bladder, quantity of snow can be varied widely. Moreover, the $CO_2$ snow formed within the bladder will be distributed evenly throughout. The gases produced during sublimation of the $CO_2$ snow will pass through the bladder vent 48 and the bladder vent restrictor 50 to the outside (i.e., the ambient) without passage into the container 10. The bladder 39 acts as a cold convection plate to chill the product stored within the lower compartment, with the reduction in temperature being controlled by the amount of surface area of the bladder making contact with the $CO_2$ snow stored within the bladder. During this mode of operation, the lower surface of bladder 39 lies substantially flush with the upper surface of the bunker 30.

In the "combined mode" of operation, liquid $CO_2$ is introduced into an end 44 of the exterior pipe section of the chill manifold 40, and caused to flow out of the spaced openings or fittings carried by the chill manifold as described above. A conventional valve mechanism (not shown) coupled with bladder 39 may be provided to selectively permit predetermined amounts of $CO_2$ gases, which form in the bladder upon sublimation of the $CO_2$ snow, to pass into the upper compartment 32 and thence to the lower compartment 34.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. Refrigeration apparatus using cryogenic refrigerant materials for storing perishable products for predetermined periods of time, comprising: an insulated container including means for dividing said container into an upper insulated compartment and a lower insulated compartment, said dividing means having apertures extending therethrough, an expandable bladder disposed atop said dividing means, said bladder being expandable from a collapsed state, and conduit means communicating with said upper compartment and connectable to a source of cryogenic liquid, said conduit means including first manifold means for forming cryogenic snow from the cryogenic liquid and introducing the formed cryogenic snow into said upper compartment, and second manifold means for forming cryogenic snow from the cryogenic liquid and introducing the formed cryogenic snow into said expandable bladder, said conduit means including means for selectively coupling the cryogenic liquid source to one of said first or second manifold means, whereby the refrigeration apparatus may be operated in a first mode in which the cryogenic liquid source is coupled to said first manifold means and cryogenic snow is introduced into the upper compartment so that cryogenic vapors formed upon sublimation of the cryogenic snow flow through the apertures in the dividing means and into contact with perishable products stored in the lower compartment, or a second mode in which the cryogenic liquid source is coupled with the second manifold means and cryogenic snow is introduced into the expandable bladder so that perishable products stored in the lower compartment may be chilled without being subjected to any cryogenic vapors formed upon sublimation of the cryogenic snow.

2. The refrigeration apparatus of claim 1, wherein the cryogenic liquid is carbon dioxide ($CO_2$).

3. Refrigeration apparatus using cryogenic refrigerant materials for storing perishable products, comprising: an insulated container having top, bottom, side and end walls, means for dividing said container into an upper insulated compartment and a lower insulated compartment, said dividing means having apertures extending therethrough, an expandable bladder in said upper compartment, conduit means communicating with said upper compartment and connectable to a source of cryogenic liquid, said conduit means including first manifold means for forming cryogenic snow from the cryogenic liquid and introducing the formed cryogenic snow into said upper compartment, and second manifold means for forming cryogenic snow from the cryogenic liquid and introducing the formed cryogenic snow into said expandable bladder, means forming horizontal flow channels extending along the upper surface of said bottom wall essentially from end to end thereof, said horizontal flow channels being in communication with the interior of said lower compartment, means forming additional channels extending vertically in said end walls, the lower ends of said additional channels communicating with the ends of said horizontal flow channels and the upper ends of said additional channels leading to the exterior of said container, means for selectively coupling the cryogenic liquid source to one of said first or second manifold means, whereby the refrigeration apparatus may be operated in a first mode in which the cryogenic liquid source is coupled to said first manifold means and cryogenic snow is introduced into the upper compartment so that cryogenic vapors formed upon sublimation of the cryogenic snow flow through said apertures in the dividing means and into contact with perishable products stored in the lower compartment, thence into said horizontal flow channels for exit from the container through said additional channels, or a second mode in which the cryogenic liquid source is coupled with the second manifold means and cryogenic snow is introduced into the expandable bladder so that perishable products stored in the lower compartment may be chilled without being subjected to any cryogenic vapors formed upon sublimation of the cryogenic snow.

4. Refrigeration apparatus using cryogenic refrigerant materials for storing perishable products comprising an insulated container having top, bottom, side and end walls, means for dividing said container into an upper insulated compartment and a lower insulated compartment, said dividing means having apertures extending therethrough, said aperatures being disposed adjacent said container side walls, tubular housings associated with said apertures and extending upwardly from said dividing means toward said container top wall, conduit means communicating with said upper compartment and connectable to a source of cryogenic liquid externally of said container, said conduit means including manifold means for forming cryogenic snow from the cryogenic liquid and introducing the formed cryogenic snow into said upper compartment, means forming horizontal flow channels extending along the upper surface of said bottom wall essentially from end to end thereof, said horizontal flow channels being in communication with the interior of said lower compartment, means forming additional channels extending vertically in said end walls, the lower ends of said additional channels communicating with the ends of said horizontal flow channels and the upper ends of said additional channels leading to the exterior of said container whereby crogenic vapors formed upon sublimation of the cryogenic snow in said upper insulated compartment flow into the upper ends of said tubular housings, thence through the apertures and the dividing means and into contact with perishable products stored in the lower compartment, thence into said horizontal flow channels for exit from the container through said additional channels.

5. Refrigeration apparatus using cryogenic refrigerant material for storing perishable products comprising an insulated container, a horizontal wall dividing said container into an upper portion and a lower portion, expandable bladder means supported in said container upper portion on the upper surface of said horizontal wall, means for introducing $CO_2$ snow into said bladder means to cool said bladder means and said horizontal wall to thereby cool said container lower portion, vent means for connecting said bladder means directly with the ambient air outside said container whereby the $CO_2$ vapors formed on sublimation of said $CO_2$ snow within said bladder pass directly to the ambient air without passage into said lower compartment whereby perishable products may be stored and chilled in the lower portion of said container without discoloration or contamination by exposure to $CO_2$ vapors.

* * * * *